US005868360A

United States Patent [19]

Bader et al.

[11] Patent Number: 5,868,360

[45] Date of Patent: Feb. 9, 1999

[54] VEHICLE PRESENCE DETECTION SYSTEM

[75] Inventors: Clifford Bader, West Chester; Charles De Renzi, Exton, both of Pa.

[73] Assignee: PrimeTech Electronics Inc., Quebec, Canada

[21] Appl. No.: 882,263

[22] Filed: Jun. 25, 1997

[51] Int. Cl.[6] ..... B61L 3/00

[52] U.S. Cl. ..... 246/202; 246/249; 246/293; 340/341; 324/207.13

[58] Field of Search ..... 246/122 R, 202, 246/249, 293, 473.1; 340/901, 933, 941; 324/207.13, 244

[56] References Cited

U.S. PATENT DOCUMENTS

| | | | |
|---|---|---|---|
| 1,797,302 | 3/1931 | Vantassel | 246/473.1 |
| 2,224,395 | 12/1940 | Kemmerer | 246/130 |
| 3,210,539 | 10/1965 | Malaquin | 246/249 |
| 3,271,821 | 9/1966 | Street . | |
| 3,359,417 | 12/1967 | Gallagher | 246/249 |
| 3,395,341 | 7/1968 | Malaquin . | |
| 3,573,441 | 4/1971 | Glazer . | |
| 4,179,744 | 12/1979 | Lowe . | |
| 4,283,031 | 8/1981 | Finch | 246/128 |
| 4,361,202 | 11/1982 | Minovitch | 246/167 D |
| 4,379,330 | 4/1983 | Sanville | 246/249 |
| 4,727,372 | 2/1988 | Buttemer | 246/247 |
| 4,968,979 | 11/1990 | Mizuno et al. . | |
| 5,025,218 | 6/1991 | Ramstedt | 324/334 |
| 5,471,139 | 11/1995 | Zadoff | 324/207.13 |

*Primary Examiner*—S. Joseph Morano

[57] ABSTRACT

A passive magnetic detector is provided at ground level or buried below ground level in between rails of a railroad trace at a distance from the level crossing for detecting magnetic field disturbances caused by ferromagnetic objects passing overhead on the track. Magnetic field reversals are detected in the passive detector signal. The reversal signal is analyzed and a train presence output signal is generated for controlling a level crossing gate system or other such crossing warning system. For parallel tracks, pairs of passive magnetic field detectors detect objects over each track and the reversals are analyzed to check that an inbound train does not sneak by undetected as an outbound train is leaving and passing over the same detector pair. At the level crossing, static magnetic field detectors are used to ensure that no equipment remains on the island after detecting that the moving train has left the crossing, so that the crossing gates can be safely lifted as soon as possible.

15 Claims, 6 Drawing Sheets

VEHICLE PRESENCE DETECTION SYSTEM

FIELD OF THE INVENTION

The present invention relates to a vehicle presence detection system for detecting the presence of trains or the like. In particular, the invention relates to a train presence detection apparatus for use with a level crossing gate system or other such warning system equipment, a vehicle motion detector circuit for analyzing a passive magnetic field detector output signal to generate a lane or track indicating signal, and a stationary or slow moving train presence detection apparatus for detecting an object on a railroad track at a level crossing.

BACKGROUND OF THE INVENTION

Conventional systems for detecting the presence of an oncoming train moving towards a level crossing for controlling the level crossing gate system have been relatively unsophisticated. Typically, a voltage between rails in an electrically isolated section is provided, and the conductive wheels of the train passing over the section allow for current to pass which is used to generate a signal for the level crossing gate system. While the reliability of such unsophisticated train presence detection systems is very high, the potential danger to human life by the failure of conventional systems makes it of paramount importance to provide detection apparatus which is as reliable as possible, if not 100% reliable.

In U.S. Pat. No. 4,179,744 to Lowe, a system for analyzing performance of electric traction motor powered railway locomotives is described in which the magnetic fields of electrical operating components of the electric traction motor powered vehicles are sensed. The results of the sensing are used for performance and maintenance evaluation purposes. While the speed of the train is obtained from the measurements, the system described measures the movement and operation of electrical operating components without providing useful information on the movement of vehicles containing no electrical operating components. While most trains in the United States have electric traction motors, it is possible for certain types of long freight trains to have locomotives in the middle or at the rear of the moving train. It is also possible for a train to have its traction motors turned off while still in motion. In the case that the locomotive at the front of the train is absent or turned off, detection of electrical operating components cannot be used as a reliable means for detecting the presence of a train moving towards a level crossing.

In U.S. Pat. No. 4,283,031 to Finch, a magnetic sensor for detecting the movement of a wheel of a rail car is described in which the speed and the direction of the rolling wheel can be determined. The wheel movement measurements from various sensors on each side of the level crossing are used to control the level crossing gate system. The wheel movement sensor disclosed in Finch is an active device mounted in close proximity to the moving wheel and is mounted above ground. By providing the sensor above ground and in a predetermined position adjacent the moving wheels of the train, the sensor is both exposed to the elements and exposed to risk of damage either by the train itself or by vandalism. The wheel sensor disclosed by Finch is not suitable for mounting at or below ground level.

SUMMARY OF THE INVENTION

It is an object of the present invention to provide a train presence detection apparatus which is able to detect the presence of ferromagnetic objects moving above ground with accuracy and reliability while safely housing the detection apparatus at ground level or buried below ground level so as to be protected and concealed from the elements, normal maintenance operations and vandals.

It is a further object of the present invention to provide a passive magnetic vehicle motion detector system able to distinguish between vehicle motion on adjacent tracks or lanes.

It is yet another object of the present invention to provide a train presence magnetic detection apparatus which is able to detect an object on a railroad track at a level crossing even if the object is stationary or slow moving.

According to the invention, there is provided a train presence detection apparatus for use with a level crossing gate system or other such warning system, the apparatus comprising: a passive magnetic detector provided at ground level or buried below ground level in between rails of a railroad track at a distance from the level crossing for detecting magnetic field disturbances caused by ferromagnetic objects passing overhead on the track; magnetic field reversal detection means connected to the passive detector for detecting reversals in a magnetic field detected by the passive detector and outputting a reversal signal; and train presence analyzer means for analyzing the reversal signal and outputting a train presence output signal. A magnetic reversal is a change in state or the change in sense in which a magnetic signal is changing by either increasing and then decreasing, or by decreasing and then increasing. It is not necessarily a change in net reversal of the signal through zero.

Preferably, the magnetic field reversal detection means are powered by a DC power line connected to the analyzer means and the reversal signal is an AC signal sent over the same power line. Preferably, the reversal detection means has a threshold of about 15 milligauss for generating the reversal signal.

In another aspect of this invention the AC signal uses one tone for a positive magnetic field change and another tone for a negative magnetic field change.

In yet a further aspect of this invention the train presence analyzer means outputs said presence signal when 2 reversals are detected within a period of about 5 seconds.

In an additional aspect of this invention a pair of passive magnetic detectors are provided for a pair of rails, said train presence analyzer means including means for comparing reversals from said magnetic field reversal detection means for each of said pair of passive magnetic detectors, and said train presence output signal indicates a track on which train presence is detected.

The invention also provides a vehicle motion detector circuit for analyzing at least one passive magnetic field detector output signal to generate a signal indicating a lane or track on which a vehicle is travelling and causing a disturbance in a magnetic field detected by the detector, the detector circuit comprising: analyzer means for analyzing the detector output signal to determine a sharpness thereof and for outputting the lane or track indicating signal, the sharpness being dependent on a proximity of the vehicle to the magnetic field detector while moving past, whereby the lane or track on which the vehicle is travelling is detected.

Preferably, the sharpness of the detector output signal includes a signal characteristic such as the frequency of polarity change in the signal, the intensity of the signal and the waveform shape. Also preferably, an alarm signal generator means is included for generating an alarm signal when a moving vehicle is detected which is on a track or lane closest to the detector but not when a moving vehicle is detected which is on a track or lane adjacent to the detector.

The invention further provides a stationary or slow moving train presence detection apparatus for detecting an object on a railroad track at a level crossing, the apparatus comprising: an array of magnetometer detectors provided at ground level or buried below ground level in between rails of the railroad track for detecting static magnetic field levels caused by ferromagnetic objects located overhead on the track at said crossing; recording means for recording, as recorded values, magnetic field level signal values from the detectors when no object is present on the track at the crossing; and train presence analyzer means for comparing signal values from the detectors to the recorded values and outputting a train presence output signal.

BRIEF DESCRIPTION OF THE DRAWINGS

The invention will be better understood by way of the following detailed description of a preferred embodiment with reference to the appended drawings in which.

DETAILED DESCRIPTION OF THE PREFERRED EMBODIMENT

Figure 1:
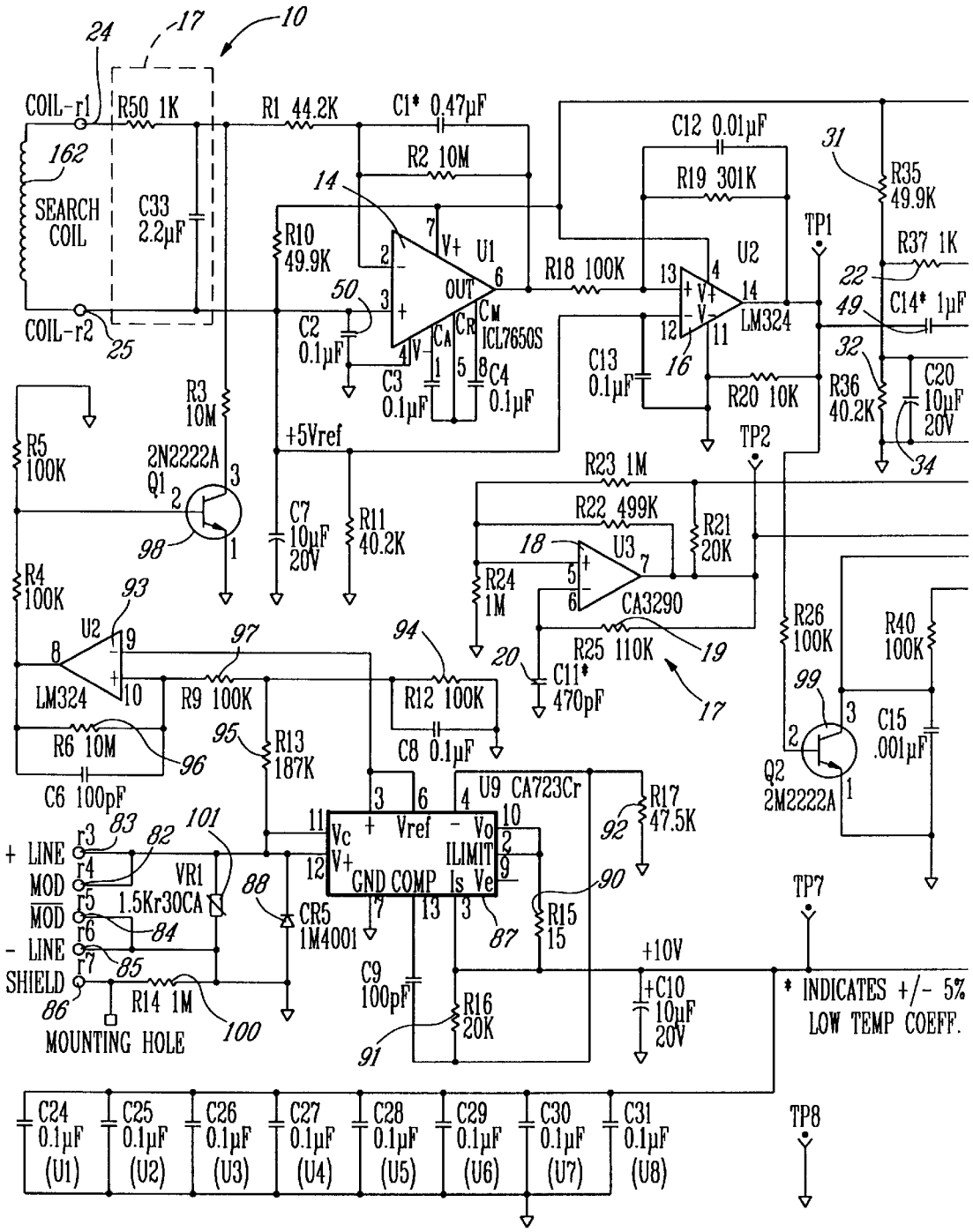
FIG. 1 is a schematic block diagram of the magnetic field reversal detection and train presence analyzer circuit according to the preferred embodiment.
Figure 2:
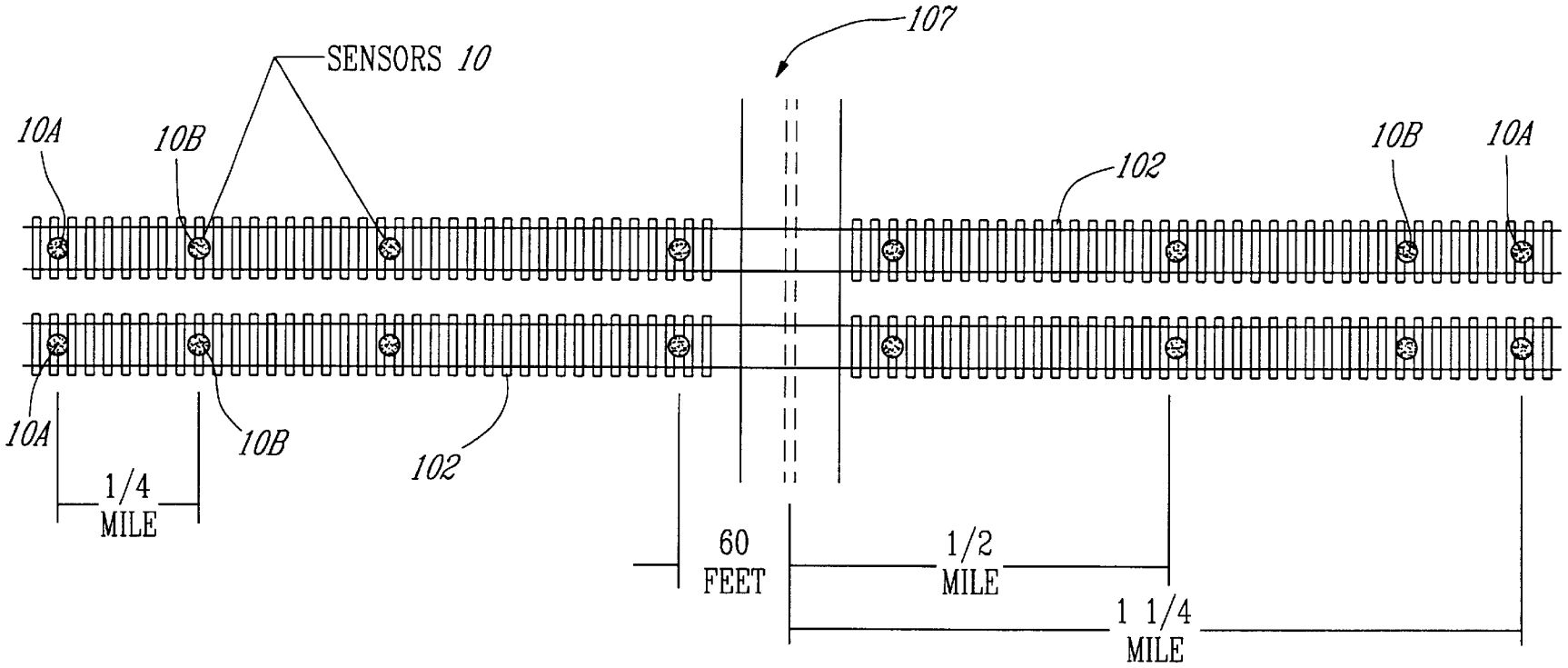
FIG. 2 is a layout diagram of a two track single crossing array.

The schematic diagram of the train presence detection circuit is shown in FIG. 1, and the layout of the installation is shown in FIG. 2. A passive "search" coil 162 is connected at terminals E1 24 and E2 25 consists of 5000 turns of number 32 AWG copper wire, having a mean diameter of 7.5 inches. The voltage induced in the coil 162 is filtered by network R50-C3 11, and amplified by chopper-stabilized integrating operational amplifier U1 14 and again by section U2(D0) 18A of quad operational amplifier U2 16. Both operational amplifiers, and all other integrated circuits except U9 83, operate from a 10 volt DC bus.

One section U3A 18A of dual comparator U3 18 forms a clock oscillator with frequency determined by resistor R25 19 and capacitor C11 20. These components are selected to provide a clock frequency of approximately 8 kilohertz. This frequency is applied to the input of seven-stage binary counter U7 21. Counter U7 21 performs multiple functions which will be discussed in turn.

Output Q1 22 of U7 21, producing a 4 kilohertz square wave voltage, feeds the clock inputs of dual flip-flop U4 23. Section 2 of U4 23 is operated as a complementing or divide-by-two flip-flop connected output Q2(not) to input D1. Output Q2 U4 23 produces a 2 kilohertz square wave. The square wave is attenuated by voltage divider network R39 26 R37 22 to approximately 30 millivolts peak-to-peak, and applied to the positive input of the second section U3B 18B of comparator U3 18. The 30 millivolt square wave rides on a DC reference voltage of approximately 4.4 volts, produced by network R3 31 and R36 32 and stabilized by capacitors C19 33 and C20 34.

The D1 23A input of U4 23 is driven by the output of U3B 18B. Two-input NOR gates, sections A 37A and B 37B of U5 37, compare the states of the two flip-flops U4 23. If the flip-flops are in opposite states (Q1 high and Q2 low or vice-versa), the output of both NOR gates is low. The NOR gates drive two control inputs 1 and 2 of analog switch U6 38. The analog switches remain in the OFF condition when the control inputs are low.

Since the D1 input of U4 23 is controlled by the 18B output, the flip-flops can toggle in opposite states only if that output changes state at the 2-kilohertz rate. This in turn requires that the U3B 18B negative-input voltage be at a level between the limits of the voltage excursions at its positive input, or approximately 4.4 volts plus or minus 15 millivolts.

If the U3B 18B negative-input voltage is lower than the minimum positive-input voltage, the U3B 18B output remains high and flip-flop 1 of dual flip flop 23 remains in the Q1 state, so that Q1(not) is low. When flip-flop 2 of dual flip-flop 23 is in the Q2 state, Q2(not) is also low, making the output on pin 4 37B of U5 37 high. Control input 1 of analog switch U6 38 is then high, turning on the switch and applying 10 volts to one terminal of feedback resistor R47 48. Current through R47 48 charges capacitor C14 49 (which is connected between the U3B 18B negative input and the output of operational amplifier U2D) during the 500-microsecond interval in which Q2(not)output of dual flip flop 23 remains low. The charge delivered is sufficient to change the voltage on C2 50 by approximately 15 millivolts, or half of the 30-millivolt excursion range of the U3B 18B positive input. Thus, the condition is re-established by which both flip-flops toggle and maintain opposite states.

If the U3B 18B negative-input voltage is higher than the maximum positive-input voltage, the U3B 18B output stays low. Q1 98 stays low, and analog switch 2 of U6 38 is turned on when Q2 99 is low. Switch 2 connects R47 48 to common rather than to 10 volts, and charge is bled from C14 49. This lowers the voltage on the U3 18B negative input and again establishes the toggling condition.

It can be seen that the circuit acts to oppose any change of the voltage at the U3 18B negative input. Therefore, when a magnetic influence acts on the search coil 162 and produces a voltage change at the output of U2D 16, the circuit adds or subtracts charge to cancel the change. The sense in which the field is changing determines whether U6 38 analog switch 1 or 2 is activated, and thereby provides an indication of the sense. The sensitivity is set by the half-amplitude of the square-wave perturbations at the U3B 18B positive input (15 millivolts) and the gain of the integrator and amplifier, and is set to be approximately 15 milligauss in the preferred embodiment.

The outputs of the aforementioned NOR gates 37A and 37B are applied to the two inputs of a set-reset flip-flop comprised of the two remaining NOR gates C 37C and D 37D of U5 37. Filter networks R42 45B, C23 45D and R41 45A, C22 45C prevent spurious triggering of the set-reset flip-flop 37D and 37C by transient voltage spikes which may occur during transitions of the flip-flop 37D and 37C outputs of U4 23. The state of the set-reset flip-flop 37D and 37C is determined by the last output from the NOR gates 37D and 37C, and hence on whether C14 49 was last charged or discharged.

The outputs of the set-reset flip-flop 37D and 37C are applied to the control inputs of quad analog switch U8 47, with U5C controlling switches 2 and 3, and U5D controlling switches 1 and 4. Switch 1 connects to the 250-hertz square wave present on the Q5 output of U7 21, switch 2 to the 500-hertz square wave at the Q4 output of U7 21, switch 3 to the 4 kilohertz square wave at the Q1 output of U7 21, and switch 4 to the 2 kilohertz square wave at the Q2 output of U7 21.

Operational amplifier sections U2A 68 and U2B 69, in conjunction with field-effect transistors Q3 71 and Q4 72, comprise modulators for superimposing carrier-frequency information on the current drawn by the sensor. Amplifier U2A 68 and transistor Q3 71 constitute a two-pole Butterworth active filter and transconductance amplifier with a cutoff frequency of approximately 665 hertz and a current output at the drain of Q3 71 of 5 milliamperes per volt of in-band input. Resistors R28 74, R30 75 and R32 76 establish a voltage swing of approximately 0.6 to 2.6 volts at the filter/amplifier input when the output of analog switches 1 or 2 of U8 47 swing from zero to 10 volts; the corresponding output current swing is from 3 to 13 milliamps. This swing provides the plus-or-minus 5 milliamp excursions which comprise the desired modulation level, while maintaining a current flow at all times to insure linearity (i.e., class A amplification).

If output U5C of the set-reset flip-flop 37C and 37D is high, switch 2 of U8 is closed and a 500 hertz square wave is applied to the input of the filter/amplifier U2A-Q3. If output U5D is high, switch 1 is closed and a 250 hertz square wave is applied to the input of filter/amplifier U2A-Q3.

Similar actions take place at the second filter/amplifier U2B-Q4 69 and 72. In this case, a high condition at U5C 37C produces a 4-kilohertz output, and a high condition at U5D 37B produces a 2 kilohertz output. In lieu of the Butterworth active filter configuration used for U2A-Q3 68 and 71, the circuit for U2B-Q4 69 and 72 uses a simple passive resistance-capacitance low-pass network consisting of C18 49 and the equivalent Thevenin resistance of the network R29 77, R31 78, and R34 79, which yields a cutoff frequency of approximately 13 kilohertz. The flat passband and sharp cutoff of the Butterworth filter is necessary to prevent harmonics of the lower two frequencies from interfering with those of the upper two frequencies, when two sensors are used on a line. Harmonics of the upper frequencies do not materially affect system operation, so that the filtering requirements are less stringent.

When a sensor is installed as part of a system, either the upper or lower modulation register must be selected. This is accomplished using a field-installed jumper from either the E8 80 (LF MOD) or E9 81 (HF MOD) terminal to the positive line via terminal E4 82 (MOD). The unused terminal E9 81 or E8 80 is left open or tied to the negative line at terminal B5 82 (MOD not). This disables the unused modulation channel.

Surge protector VR1 101 and diode CR5 88 protect the sensor against voltage transients or line polarity reversal. The input voltage, which must be in the range 13–28 volts, is applied to voltage regulator U9 87. The internal 7-volt reference of U9 87 is compared with its output voltage via voltage divider R16 91 and R17 92, which establish the 10-volt bus level for the remaining integrated circuits. Resistor R15 90 samples the current and allows U9 87 to limit its output to about 40 milliamperes as a protective measure.

The 7-volt reference is also fed to the negative input of amplifier U2C 93, used as a comparator. The positive input of U2C 93 is fed from voltage divider R12 94, R13 95, with R6 96 and R9 97 providing a small amount of hysteresis to facilitate reliable output transitions. When the line voltage is raised above approximately 20 volts, the output of U2C 93 goes high, turning on transistor Q1 98 and drawing a small current (approximately 0.5 microampere) from the search coil 10 and via its input filter network R50-C33 11. If the search coil 162 is present and has its normal resistance of 1600 ohms, the output amplifier U2C 93 then decreases by approximately 1 volt with a 5-second time constant. Thus, by controlling the time for which the line is held above 20 volts, an output of the desired level may be produced at U2C 93, and the sensor response may be checked to see that one or two reversal events result. This constitutes the self-test function.

If the search coil 162 is shorted, the voltage change at U2D 16 will be absent or greatly attenuated. If, on the other hand, the coil is open, U1A 14 will saturate at its upper voltage limit and U2D 16 at its lower voltage limit.

When the voltage at the output of U2D 916 falls below approximately 0.7 volts, transistor Q2 99, which is normally conducting, cuts off. The collector of Q2 99 is connected to the RESET input of binary counter U7 21. When Q2 16 cuts off, the counter is held in the reset mode and produces no square-wave outputs; thus, modulation is inhibited and the sensor does not produce a carrier signal. The disappearance of the carrier during self-test thus indicates an open search coil.

Q2 99 also acts to cut off the carrier if a magnetic disturbance is large enough to saturate U2D 16 in its low state. This provides an indication that the dynamic range of the sensor has been exceeded. While the preferred embodiment does not include a similar feature for positive saturation of U2D 16, the addition of such a circuit could readily be accomplished.

As a precaution against noise pickup and to provide additional protection against voltage transients due to nearby lightning strikes, it is desirable that the two-wire line to the sensor be shielded, and that the shield not be used as an active conductor. A terminal E7 86 and resistor R14 100 are included to provide a means for preventing any charge buildup between the sensor circuitry and the shield. Internal shielding of the sensor assembly is also connected to E7 86. The shield should be connected to a good earth ground at the central logic controller.

As shown in FIG. 2, passive magnetic detectors or sensors 10 are provided in pairs starting 1.25 miles from the crossing under both sets of parallel track 102. Of course, if the configuration is for a single track, coil pairs 10 are not required. The outermost search coils 10A are spaced by a 0.25 mile with respect to the second pairs of search coils 10B. The second pairs of search coils 10B confirm the presence of an oncoming train and are used to confirm the speed of the train by measuring the time difference between passing over the outermost pairs of search coils 10A to the time of passing over the second pair of search coils 10B. The speed of approach of the oncoming train is taken into consideration for the purposes of timing the control of the level crossing gate system or other such warning system. For example, a very high speed train would cause the level crossing gate system to begin flashing the warning lights and close the gate almost immediately whereas a slow moving train may cause the train presence detection system to wait until the train crosses the 0.5 mile sensors 10 or an appropriate time period depending on the speed before beginning to close the gate at the level crossing.

Figure 3:
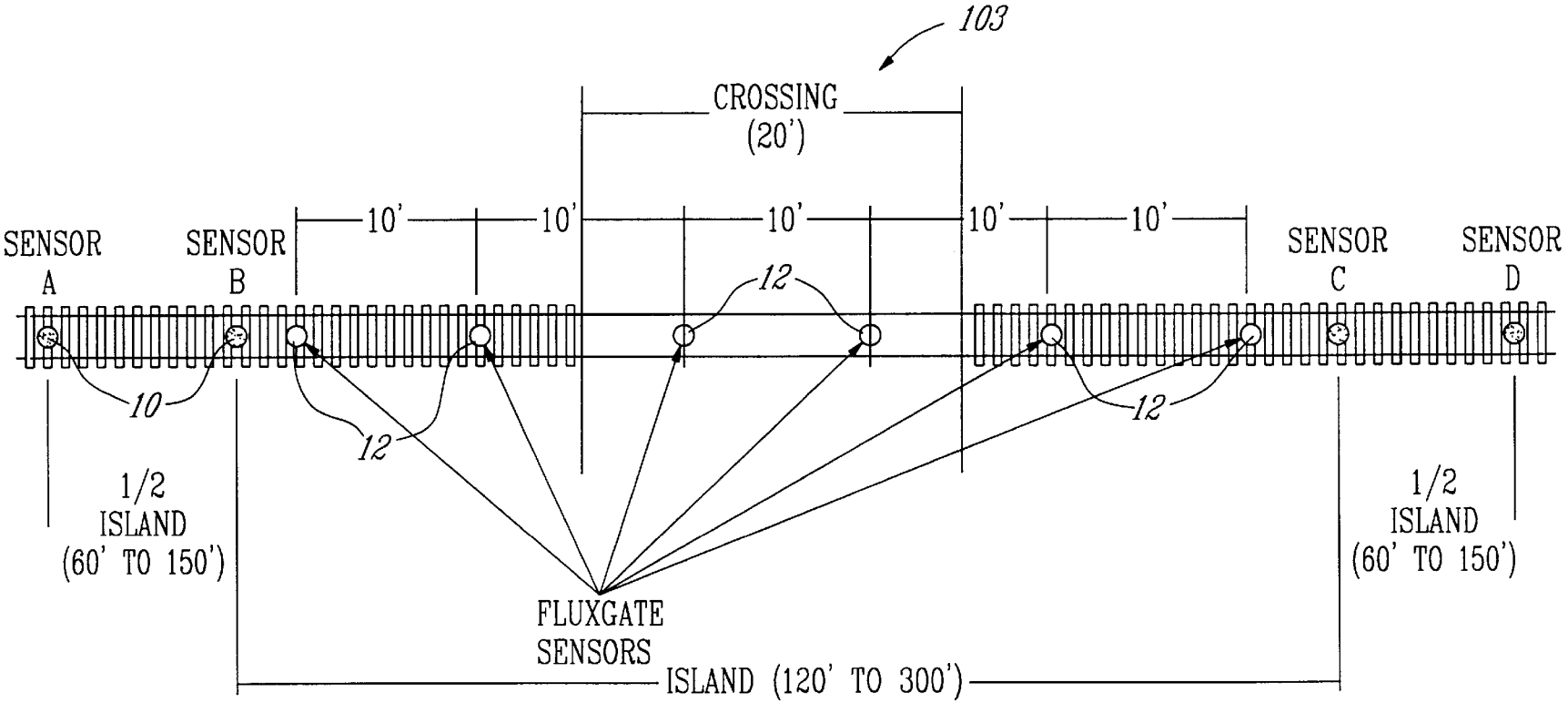
FIG. 3 is an enlarged view of the layout shown in FIG. 2 showing details of flux gate sensors installed at the level crossing and level crossing island.

As illustrated in FIG. 3, most level crossings 103 include an island of about 120 ft. to 300 ft. whereas the actual road surface at the point of crossing is typically about 20 ft. to 40 ft. According to the invention, six flux gate sensors 12 are provided at 10 ft. intervals to span a distance of about 50 ft. The number of flux gate sensors 12 and the span of the linear array of flux gate sensors 12 may be greater. The flux gate sensors 12 are magnetometer devices which measure the level of magnetic field at various points at the ground level along the track. By measuring and recording the magnetic field values when no train is present, a comparison of the field values when the gates are down can be compared to the recorded values. This determines with maximum security that all train cars have left the level crossing and that no stray vehicle has been left or has moved onto the level crossing island. Of course, by using an array of magnetometers and comparing signal values from the magnetometer detectors of all of the flux gate sensors 12, it is possible to determine whether a large ferromagnetic object is present over the railroad track. Such a large object will affect the readings of the flux gate sensors 12 over a number of sensors and such variations with respect to the prerecorded values can be analyzed to ascertain with confidence that a vehicle is present on the track at the island. As can be appreciated, the detection of a stationary vehicle on the island can result in an emergency service call to despatch a crew to the level crossing in order to ensure that the stationary rail vehicle is removed from the island and safely returned to its place so that the level crossing can be cleared.

Preferably, the flux gate sensors 12 are read and recorded as soon as the gate is lowered. This occurs, as mentioned above, a some point in time after the outermost search coils 10 indicate that a train is approaching. The memory storing the recorded values may also contain the recorded values from previous "clear" readings. It is possible for the magnetic field readings to change over time, as for example if rails are left on the side of the tracks near the island. If the flux gate sensor 12 values read after the train leaves the island are consistent with the "historical" "clear" values, but not the values read when the crossing gate was lowered, it may be decided to raise the crossing gate (or deactivate the warning system). Of course, if the historical values are not consistent with the latest clear values, and the sensor values after the train leaves the island are consistent with the latest clear values, the crossing gate will be lifted, and the latest clear values will be assigned to the historical values.

Figure 4:
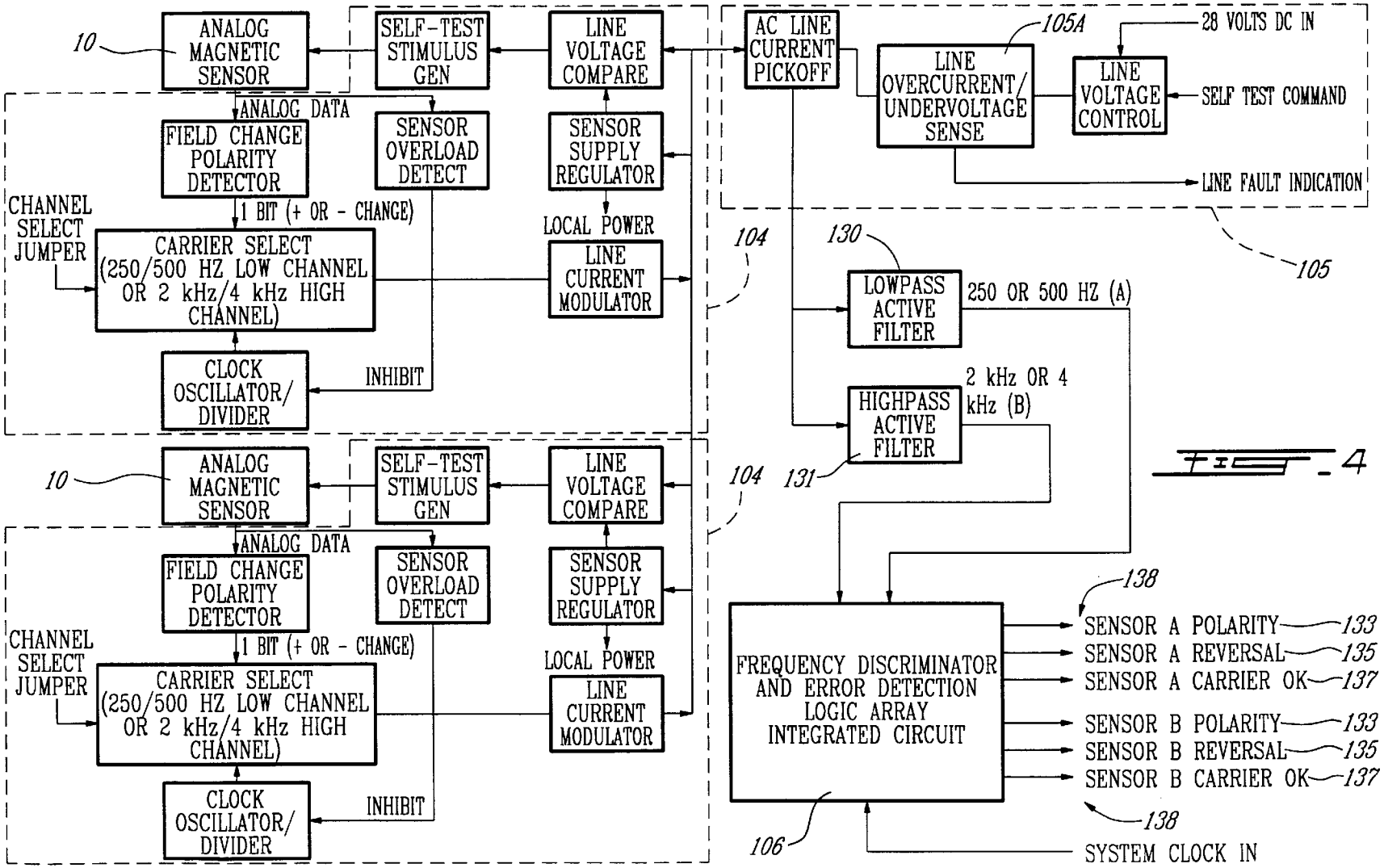
FIG. 4 is a schematic block diagram of the system shown in FIG. 1.

As can also be appreciated, the present invention provides a detection system for adjacent parallel tracks 102 of FIG. 2. In the arrangement illustrated in FIG. 4, the pair of search coils 10 and magnetic field reversal detection circuits 104 communicate over a long distance power line 105 to a train presence analyzer circuit shown in FIG. 4 as the frequency discriminator and error detection logic array integrated circuit 106. Since passive search coils 10 receive a considerable readable signal from moving rail vehicles on the adjacent track, it is important to be able to distinguish between moving rail vehicles on different tracks. In the preferred embodiment, this is done by comparing the number of reversals detected in each of the search coils 10. If one search coil 10 detects fewer reversals than the number of reversals detected by the other coil on the other track, it is presumed that the one track does not have a moving train on it. The object of this detection system is to prevent the possibility of an oncoming train approaching the level crossing 107 of FIG. 2 undetected by being masked by the presence of a train on the adjacent track moving away from the level crossing 107. The train presence detection system according to the preferred embodiment solves this problem by comparing reversals detected at each pair of search coils 10.

As can be appreciated, a single passive coil provided at one track is able to detect the movement of ferromagnetic vehicles passing along an adjacent track, however, analyzer circuitry may be provided to determine a sharpness of the passive coil detector output signal to determine whether the vehicle is moving in the same track or on an adjacent track. The sharpness of the detector output signal can be measured by the number of reversals or the frequency of reversals as well as the intensity and waveform of the passive coil detector output signal.

Figure 5:
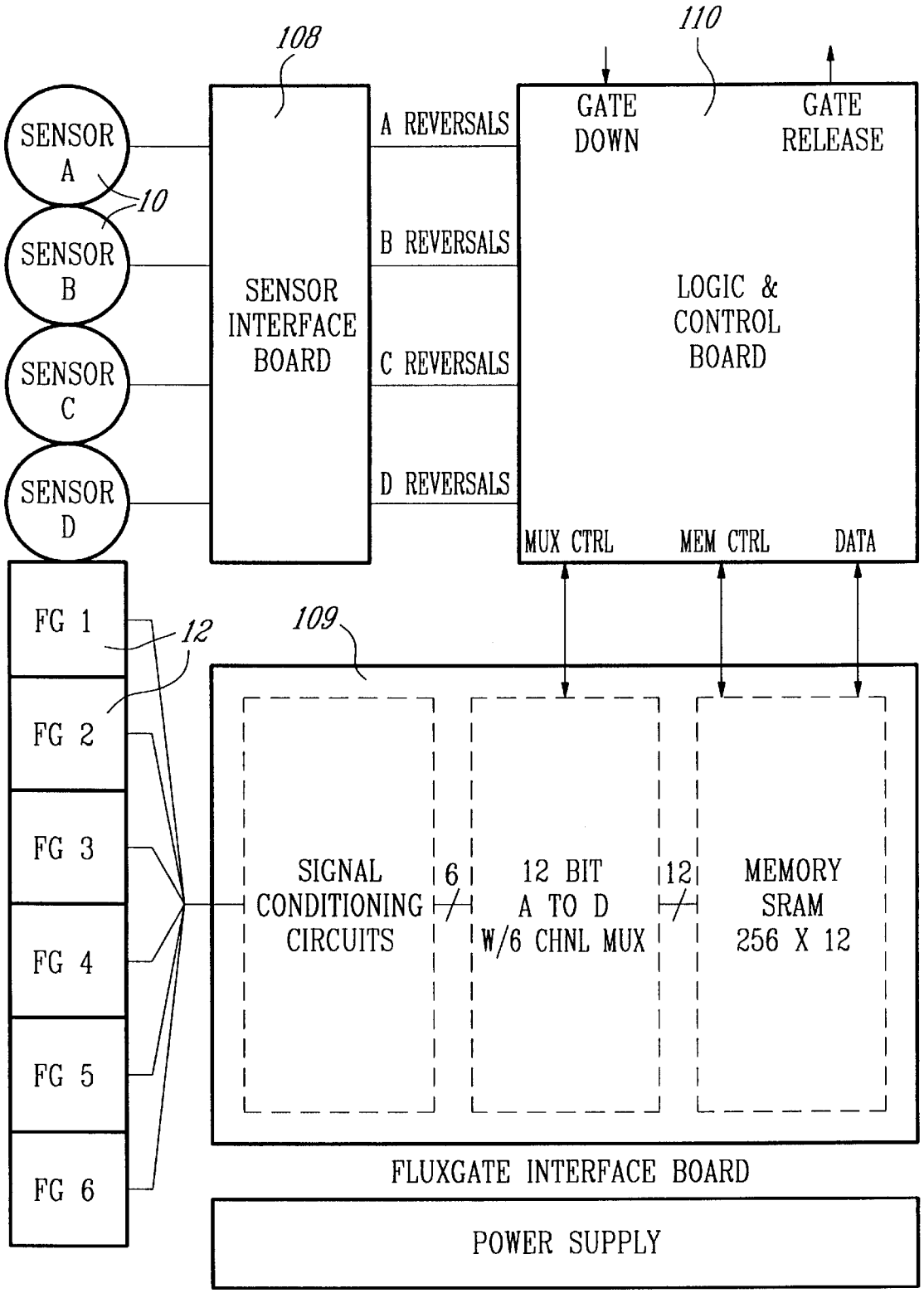
FIG. 5 is a block diagram of the recording means and train presence analyzer circuit for the stationary or slow moving train presence detection circuit according to the preferred embodiment.
Figure 6:
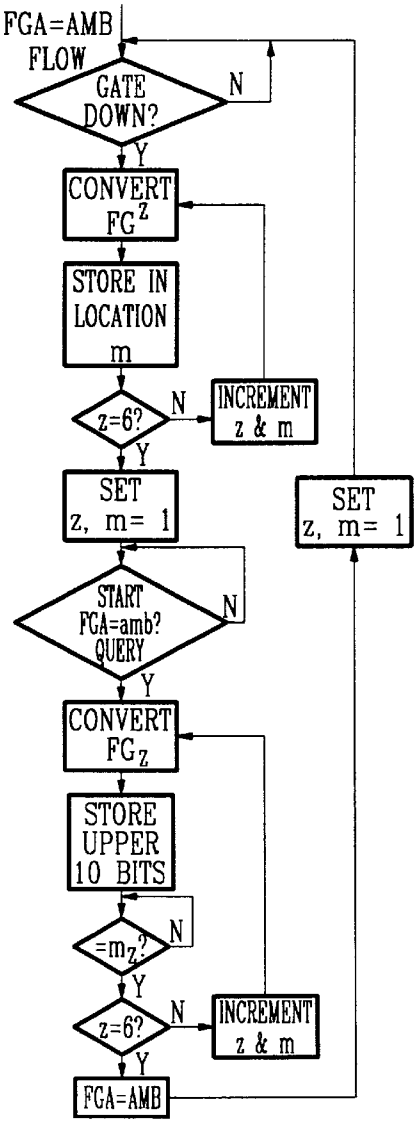
FIG. 6 is a system flow chart for the stationary or slow moving train presence detection system according, to the preferred embodiment.
Figure 6:
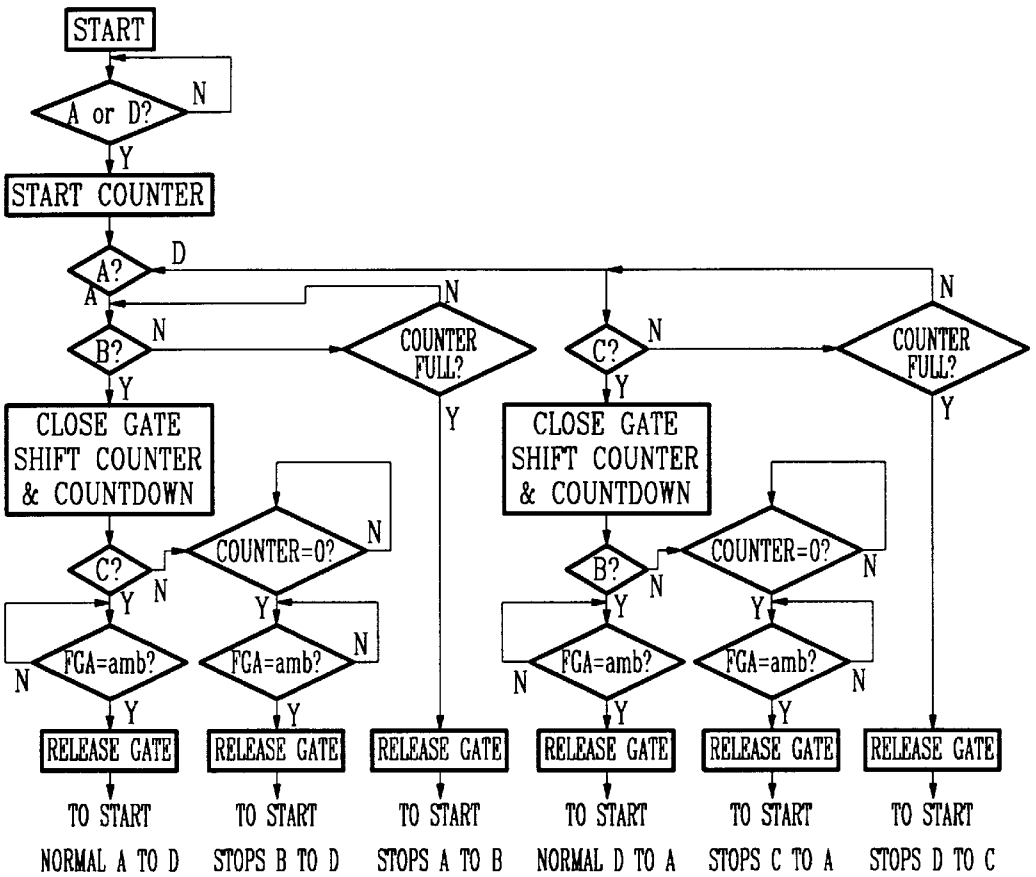
Figure 1:
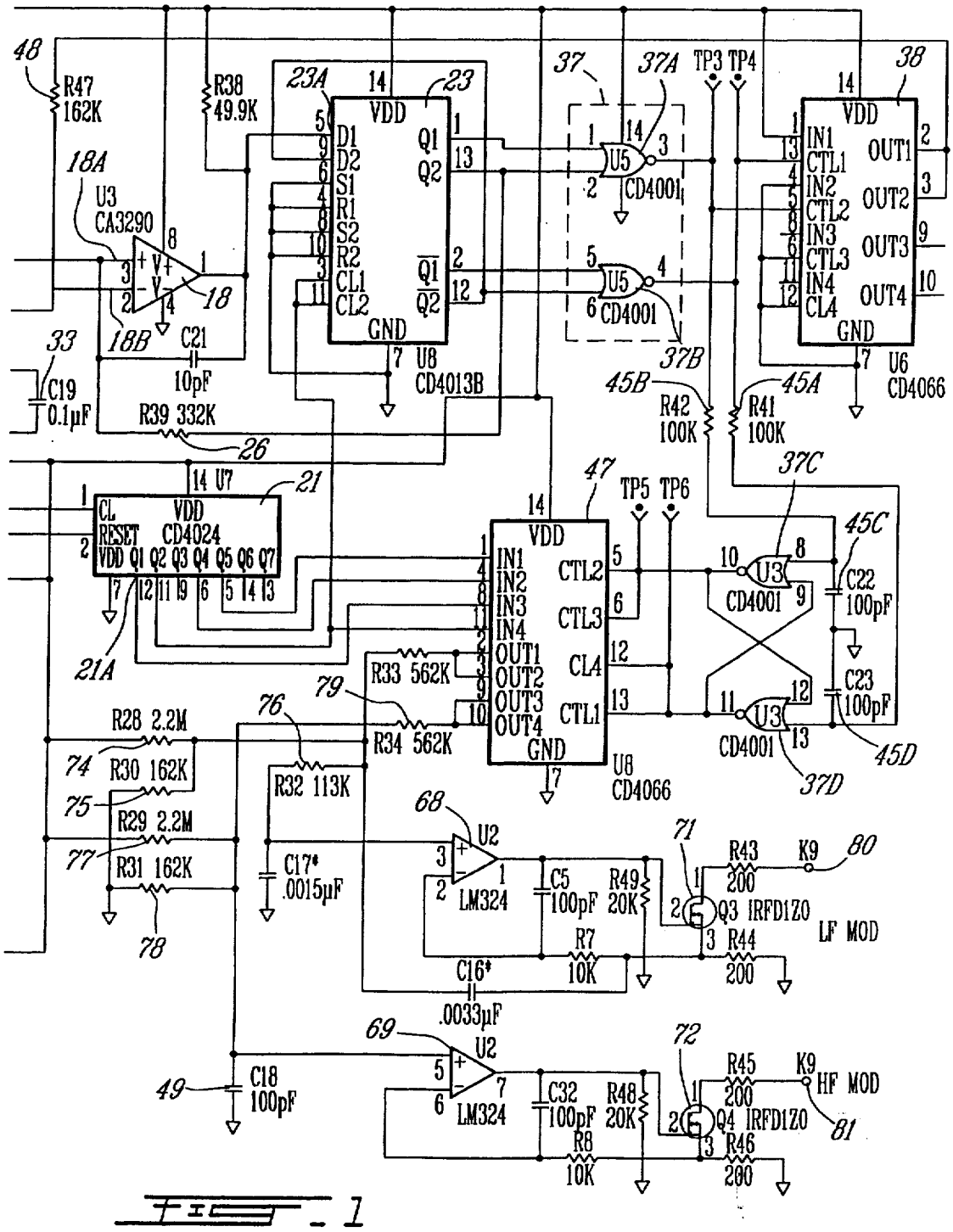

As shown in FIG. 5, the preferred embodiment provides a sensor interface board 108 connected to each of the four search coils 10, or pairs of search coils 10, as well as a flux gate interface board 109 connected to each of the six magnetometer detectors 12 spaced at 10 ft. apart. A single logic and control data processor 110 receives the reversal data and the flux gate reading data and processes this information to control the level crossing gate. The data processing and decision making logic of the logic and control board 110 illustrated in FIG. 5 is illustrated in FIG. 6.

Although the invention has been described hereinabove with reference to a preferred embodiment, it is to be understood that the scope of the invention encompasses a variety of embodiments of the invention as defined in the appended claims.

We claim:

1. A train presence detection apparatus for use with a level crossing warning system, the apparatus comprising:

at least one passive magnetic detector provided at ground level or buried below ground level in between rails of a railroad track at a distance from said level crossing for detecting magnetic field disturbances caused by ferromagnetic objects passing overhead on said track;

magnetic field reversal detection means connected to said passive detector for detecting a plurality of reversals in a magnetic field detected by said passive detector and outputting a reversal signal; and train presence analyzer means for analyzing said reversal signals and outputting a train presence output signal.

2. The apparatus as claimed in claim 1, wherein said reversal detection means are powered by a DC power line connected to said analyzer means, said reversal signal being an AC signal sent over said power line.

3. The apparatus as claimed in claim 2, wherein said AC signal comprises one tone for a positive magnetic field change and another tone for a negative magnetic field change.

4. The apparatus as claimed in claim 2, wherein said reversal detection means has a threshold of about 15 milligauss for generating said reversal signal.

5. The apparatus as claimed in claim 2, wherein said train presence analyzer means outputs said presence signal when 2 reversals are detected within a period of about 5 seconds.

6. The apparatus as claimed in claim 2, wherein said passive magnetic detector comprises a linear array of search coils, said linear array including a first outermost coil at approximately 1.25 miles from said level crossing, a second of said coils at approximately 1 mile from said crossing, said train presence analyzer means including means for determining a speed of an oncoming train for adjusting a timing of activation of said level crossing warning system.

7. The apparatus as claimed in claim 1, wherein said reversal detection means has a threshold of about 15 milligauss for generating said reversal signal.

8. The apparatus as claimed in claim 1, wherein said train presence analyzer means outputs said presence signal when 2 reversals are detected within a period of about 5 seconds.

9. The apparatus as claimed in claim 1, wherein a pair of passive magnetic detectors are provided for a pair of rails, said train presence analyzer means including means for comparing reversals from said magnetic field reversal detection means for each of said pair of passive magnetic detectors, and said train presence output signal indicates a track on which train presence is detected.

10. The apparatus as claimed in claim 1, wherein said passive magnetic detector uses a coil as part of its detecting circuitry.

11. A vehicle motion detector circuit for analyzing at least one passive magnetic field detector output signal to generate a signal indicating on which one of a plurality of lanes or tracks a vehicle is traveling and causing a disturbance in a magnetic field detected by said detector, the detector circuit comprising: analyzer means for analyzing said detector output signal to determine a sharpness thereof and for outputting said lane or track discriminating indicating signal, said sharpness being dependent on a proximity of said vehicle to said magnetic field detector while moving past, whereby the lane or track on which said vehicle is traveling is detected.

12. The circuit as claimed in claim 11 wherein said sharpness of said detector output signal includes signal characteristics selected from the group of frequency of polarity change, intensity and waveform shape.

13. The circuit as claimed in claim 11, further comprising an alarm signal generator means for generating an alarm signal when a moving vehicle is detected which is on a track or lane closest to the detector but not when a moving vehicle is detected on a track or lane adjacent the detector.

14. The circuit as claimed in claim 11, wherein said analyzer means includes magnetic field reversal detection means and a comparator means for comparing a number of reversals within a predetermined time period for determining said lane or track on which said vehicle is travelling.

15. A stationary or slow moving train presence detection apparatus for detecting an object on a railroad track at a level crossing, the apparatus comprising:

an array of magnetometer detectors provided at ground level or buried below ground level in between rails of said railroad track for detecting static magnetic field levels caused by ferromagnetic objects located overhead on said track at said crossing;

recording means for recording, as recorded values, magnetic field level signal values from said detectors when no object is present on said track at said crossing; and train presence analyzer means for comparing signal values from said detectors to said recorded values and outputting a train presence output signal.

* * * * *

UNITED STATES PATENT AND TRADEMARK OFFICE

CERTIFICATE OF CORRECTION

PATENT NO : 5,868,360

DATED : Feb. 9, 1999

INVENTOR(S): Clifford BADER et al

It is certified that error appears in the above-identified patent and that said Letters Patent is hereby corrected as shown below:

In the Abstract, line 2, change "trace" to --track--;

Col. 7, line 32, change "a" to --at--;

In the drawings, kindly insert the second sheet of Figure 1.

Drawings sheets 1 of 6 should read 1 of 7.

Signed and Sealed this

Thirty-first Day of October, 2000

*Attest:*

Q. TODD DICKINSON

*Attesting Officer*

*Director of Patents and Trademarks*